US005870656A

United States Patent [19]

Hibino et al.

[11] Patent Number: 5,870,656

[45] Date of Patent: Feb. 9, 1999

[54] IMAGE FORMING APPARATUS FOR EFFECTING DEVELOPMENT AND CLEANING BY USING MAGNET BRUSH

[75] Inventors: Masaru Hibino, Ashigara; Yoshiaki Kobayashi; Koichi Hashimoto, both of Namazu; Ichiro Ozawa, Susono, all of Japan

[73] Assignee: Canon Kabushiki Kaisha, Tokyo, Japan

[21] Appl. No.: 982,341

[22] Filed: Dec. 2, 1997

[30] Foreign Application Priority Data

Dec. 4, 1996 [JP] Japan ..... 8-338870
Dec. 6, 1996 [JP] Japan ..... 8-342434

[51] Int. Cl.[6] ..... G03G 15/30
[52] U.S. Cl. ..... 399/149
[58] Field of Search ..... 399/267, 356, 399/149, 150

[56] References Cited

U.S. PATENT DOCUMENTS 5,075,728 12/1991 Kobayashi et al. ..... 399/281
5,173,388 12/1992 Uezono et al. ..... 399/267 X
5,606,400 2/1997 Nagayasu et al. ..... 399/150 X

*Primary Examiner*—S. Lee
*Attorney, Agent, or Firm*—Fitzpatrick, Cella, Harper & Scinto

[57] ABSTRACT

An image forming apparatus having an image bearing member for bearing an electrostatic image to be developed by toner, a transfer device for transferring a toner image formed on the image bearing member onto a transfer material, and developing and cleaning device for developing the electrostatic image with developer including toner and carrier and for cleaning residual toner remaining on the image bearing member after transferring, the developing and cleaning device having a developer bearing member for bearing the developer and serving to effect development and cleaning by causing a magnet brush formed by the carrier to contact with the image bearing member, and wherein the following relation is satisfied:

$$|V_{s1}V_{dr}|/|V_{dr}|\times L\times m\times\alpha\geqq 7$$

(where, $V_{s1}$ is a moving speed (mm/sec.) of a surface of the developer bearing member, $V_{dr}$ is a moving speed (mm/sec.) of a surface of the image bearing member, L is a contact width (mm) of the brush in a moving direction of the image bearing member, m is a cross-sectional area ($mm^2$) of the magnet brush, and $\alpha$ is density (flux/$mm^2$) of the magnet brush).

6 Claims, 6 Drawing Sheets

IMAGE FORMING APPARATUS FOR EFFECTING DEVELOPMENT AND CLEANING BY USING MAGNET BRUSH

BACKGROUND OF THE INVENTION

1. Field of the Invention

The present invention relates to an image forming apparatus such as a copying machine, a printer and the like, and more particularly, it relates to an image forming apparatus in which residual toner remaining on an image bearing member can be collected by a developing device.

2. Related Background Art

Recent copying machines and printers have been digitalized as a full-color image and systematization the apparatus have been required.

For example, laser beam printers in which a photosensitive drum is scanned by a laser beam and a latent image is formed on the photosensitive drum by ON/OFF-control of the laser beam to obtain a desired image have widely been proposed. Such printers are mainly used for effecting two-value recording of characters, figures and the like. Since the recording of the characters, figures and the like does not require intermediate gradation, the printer can be simplified.

There are printers in which the intermediate gradation can be obtained by the two-value recording system. In such printers, it is well-known to utilize a dither method or a density pattern method. As is well-known, in the printers utilizing the dither method or the density pattern method, high resolving power cannot be obtained. However, recently, there has been proposed a method in which intermediate gradation can be obtained for each pixel without worsening high recording density. In such a method, the intermediate gradation is obtained by effecting pulse-width-modulation (PWM) of a laser beam by using an image signal. According to this method, an image with high resolving power and high gradation can be formed.

Now, an example of an image forming apparatus utilizing the above-mentioned method will be explained with reference to FIG. 4.

In FIG. 4, when a copy start signal is inputted, a photosensitive drum 201 is charged to a predetermined potential by means of a charger 203. On the other hand, an original 200G rested on an original support 210 is scanned by illuminating light emitted from a unit 209 comprising an original illumination lamp, a short-focus lens array and a CCD sensor, so that light (from illumination scan light) reflected by the original is focused by the short-focus lens array and is incident on the CCD sensor.

The CCD sensor includes a light receiving portion, a transmitting portion and an output portion. In the light receiving portion, the light signal is converted into a charge signal, and, in the transmitting portion, the charge signals are successively transmitted to the output portion in synchronism with clock pulses. Then, in the output portion, each charge signal is converted into a voltage signal which is in turn amplified and impedance-reduced and then is outputted. An analogue signal so obtained is subjected to conventional image treatment to change a digital signal which is in turn sent to a printer portion.

As shown in FIG. 5, in the printer portion, light emitted from a solid laser element 102 ON/OFF-emission-controlled in response to the image signal is scanned by a polygon mirror 104 rotating at a high speed, thereby forming an electrostatic latent image corresponding to an image of the original on the photosensitive drum 201.

Next, a laser scan portion 100 for scanning a laser beam will be described with reference in FIG. 5.

When the laser beams are scanned by the laser scan portion 100, first of all, the solid laser element 102 is switched (between bright and dark) at a predetermined timing by a light-emitting signal generator 101 in response to the inputted image signal. Laser beams emitted from the solid laser element 102 are converted into substantially parallel light fluxes by a collimator lens system 103. The light fluxes are scanned in a direction shown by the arrow $C_0$ by the polygon mirror 104 rotating in a direction shown by the arrow b and are focused onto a scanned surface 106 (surface to be scanned) as a spot by means of a group of fθ lenses 105*a*, 105*b*, 105*c*.

Exposure distribution corresponding to one scan image is formed on the scanned surface 106 of the photosensitive drum 201. Whenever the scan is effected, by scrolling the scanned surface 106 by a predetermined amount in a direction perpendicular to the scan direction, entire exposure distribution corresponding to the image signal can be formed on the scanned surface 106.

Then, the electrostatic latent image is developed by a developing device 204 containing a two-component developer (including toner particles and carrier particles), thereby forming a toner image on the photosensitive drum 201.

Now, a developing process will be described. Generally, the developing methods are divided into foul methods. In the first method, non-magnetic toner is coated on a developing sleeve by a developing blade to form a toner layer and development is performed without contact between the toner layer and the photosensitive drum (one-component non-contact development). In the second method, magnetic toner is coated on a developing sleeve by a magnetic force to form a toner layer and development is performed without contact between the toner layer and the photosensitive drum (one-component non-contact development). In the third method, developer is constituted by mixture of toner particles and magnetic carrier particles and the developer is conveyed by a magnetic force and development is performed while contacting the toner layer with the photosensitive drum (two-component contact development). In the fourth method, developer is constituted by mixture of toner particles and magnetic carrier particles and the developer is conveyed by a magnetic force and development is performed without contact between the toner layer and the photosensitive drum (two-component non-contact development). Incidentally, the two-component contact development is widely used in the view point of high quality image and great stability.

FIG. 6 is a schematic view showing a developing device 204 of two-component magnet brush type used in the above-mentioned conventional example.

The developing device 204 includes a development container 216, and a developing sleeve 211 disposed within an opening portion of the development container in an opposed relation to the photosensitive drum 201. A fixed magnet roller 212 is disposed within the developing sleeve 211. Further, there is provided a regulating blade 215 for forming a thin toner layer on the developing sleeve 211.

The development container 216 is divided, by a partition 217, into a developing chamber R201 and an agitating chamber R202 including agitating screws 213, 214, respectively. A toner reservoir or hopper R203 is disposed above the agitating chamber R202.

The developing sleeve 211 is arranged in such a manner that a part of the sleeve nearest to the photosensitive drum 201 is spaced apart from the drum by about 500 μm. As shown in FIG. 6, the developing sleeve is rotated in a normal direction together with the photosensitive drum 201 so that the development is effected while contacting the toner with the photosensitive drum 201. A peripheral speed ratio of the developing sleeve 211 relative to the photosensitive drum 201 is normally selected to 1.5 to 2.0 times.

The toner image formed on the photosensitive drum 201 is electrostatically transferred onto a transfer material by a transfer charger 207. Thereafter, the transfer material is electrostatically separated from the photosensitive drum by a separation charger 208, and the separated transfer material is sent to a fixing device 206, where the toner image is thermally fixed to the transfer material. Thereafter, the imaged transfer material is discharged from the image forming apparatus.

After the toner image was transferred, residual toner remaining on the surface of the photosensitive drum 201 is removed by a cleaner 205, thereby preparing for next image formation.

The above-mentioned arrangement is only an example. Thus, the charger 203 may be a charge roller in lieu of a corona charger and the transfer charger 207 may be a transfer roller. However, fundamentally, the image formation is performed through charge, exposure, development, transferring, fixing and cleaning processes.

Recently, compactness of such image forming apparatuses has been promoted and progressed. However, there is the limitation merely by making the charge means, exposure means, developing means, transfer means, fixing means and/or cleaning means. Further, although the residual toner (waste toner) is collected into the cleaner 205, from the viewpoint of protection of environment, the waste toner should be reduced to be as little as possible.

To this end, there has been proposed a cleaner-less (no cleaner) device in which such a cleaner 205 is omitted and the development and the cleaning are simultaneously effected by the developing device 204 (simultaneous development/cleaning). The simultaneous development/cleaning means a technique in which residual toner remaining on the photosensitive drum (after transferring) is removed and collected by fog removing bias $V_{back}$ during the next developing process.

According to this technique, since the collected residual toner is used in the next and further developing processes, the waste toner can be eliminated. Further, since any waste toner container is not required, space can be saved, thereby permitting remarkable compactness of the apparatus.

However, in the conventional copying machines such as the above-mentioned example, when the cleaner 205 was omitted and the simultaneous development/cleaning was effected, it was found that positive ghost of the previous image is generated at a non-image portion of the photosensitive drum. The positive ghost is a phenomenon caused when a part of the residual toner (used to form the previous image) which is not completely removed is transferred onto a white background of the photosensitive drum.

SUMMARY OF THE INVENTION

An object of the present invention is to provide an image forming apparatus in which a special cleaning means for cleaning residual toner remaining on an image bearing member is omitted.

Another object of the present invention is to provide a developing apparatus in which residual toner can be collected by a developing means substantially by 100%.

A further object of the present-invention is to provide an image forming apparatus comprising an image bearing member for bearing an electrostatic latent image to be developed by toner, a transfer means for transferring a toner image formed on the image bearing member onto a transfer material, and a developing/cleaning means for developing the electrostatic latent image with developer including toner and carrier and for cleaning residual toner remaining on the image bearing member after transferring, the developing/cleaning means having a developer bearing member for bearing the developer and serving to effect development and cleaning while contacting a magnet brush formed by the carrier with the image bearing member, and wherein the following relation is satisfied:

$$|V_{s1}-V_{dr}|/|V_{dr}|\times L\times m\times\alpha\geqq 7$$

(where, $V_{s1}$ is a moving speed (mm/sec.) of the surface of the developer bearing member, $V_{dr}$ is a moving speed (mm/sec.) of the surface of the image bearing member, L is a contact width (mm) of the magnet brush in a moving direction of the image bearing member, m is a cross-sectional area ($mm^2$) of the magnet brush, and α is density (flux/$mm^2$) of the magnet brush).

The other objects of the present invention will be apparent from the following detailed explanation of the invention.

DETAILED DESCRIPTION OF PREFERRED EMBODIMENTS

The present invention will now be explained with reference to the accompanying drawings.

[First Embodiment]

Figure 1:
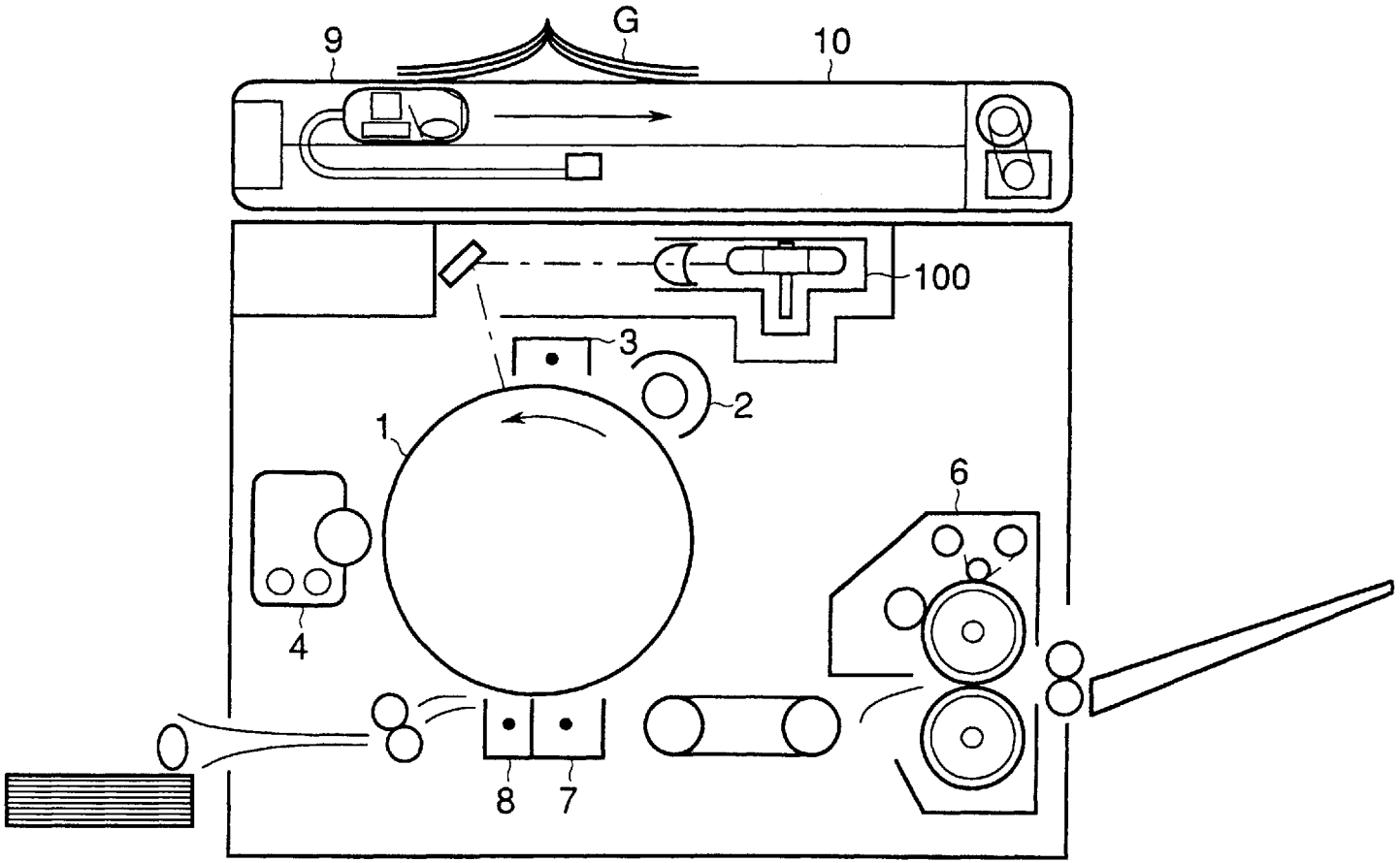
FIG. 1 is a schematic sectional view of an image forming apparatus according to a preferred embodiment of the present invention.

An image forming apparatus according to a first embodiment of the present invention will be described with reference to FIG. 1.

First of all, an original G is rested on an original support 10 with an imaged surface (to be copied) facing downwardly. Then, when a copy button is depressed, a copying operation is started. The original G is scanned by illuminating light emitted from a unit 9 comprising an original illumination lamp, a short-focus lens array and a CCD sensor, so that light (from illumination scan light) reflected by the original is focused by the short-focus lens array and is incident on the CCD sensor.

The CCD sensor includes a light receiving portion, a transmitting portion and an output portion. In the light receiving portion, the light signal is converted into a charge signal, and, in the transmitting portion, the charge signals are successively transmitted to the output portion in synchronous with clock pulses. Then, in the output portion, each charge signal is converted into a voltage signal which is in turn amplified and impedance-reduced and then is outputted. An analogue signal so obtained is subjected to conventional image treatment to change a digital signal which is in turn sent to a printer portion.

Figure 5:
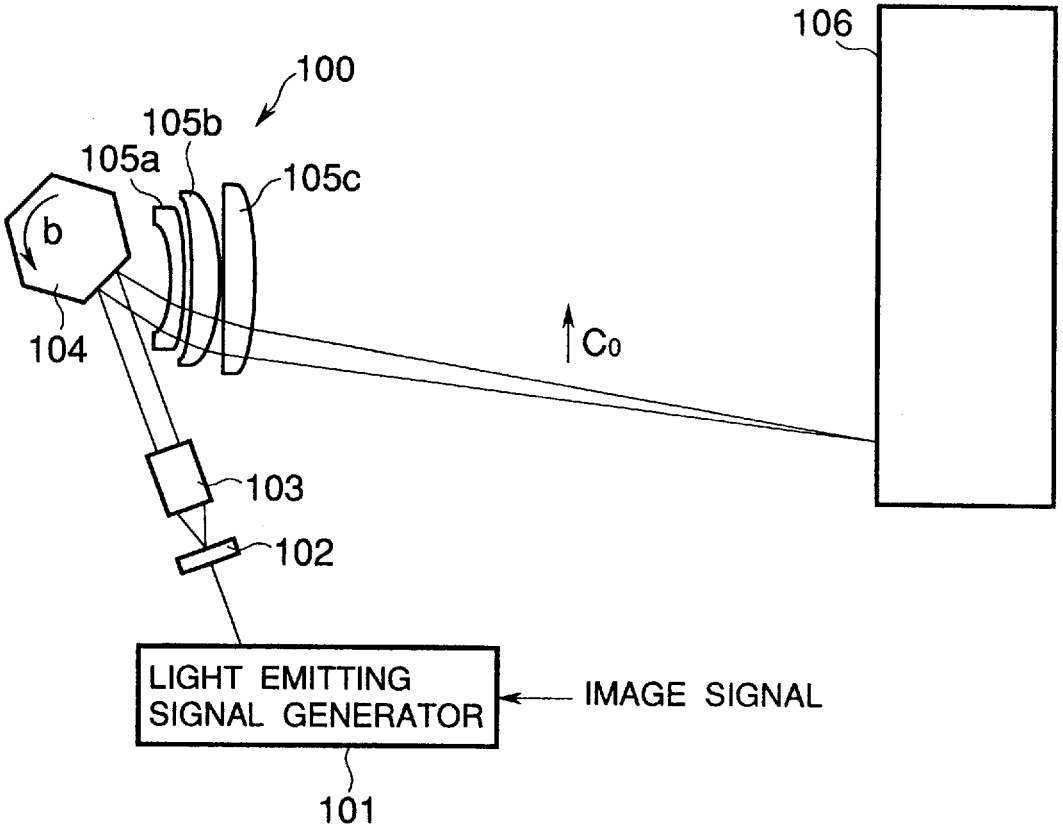
FIG. 5 is a schematic view showing a laser operation portion of the image forming apparatus of FIG. 4.
Figure 6:
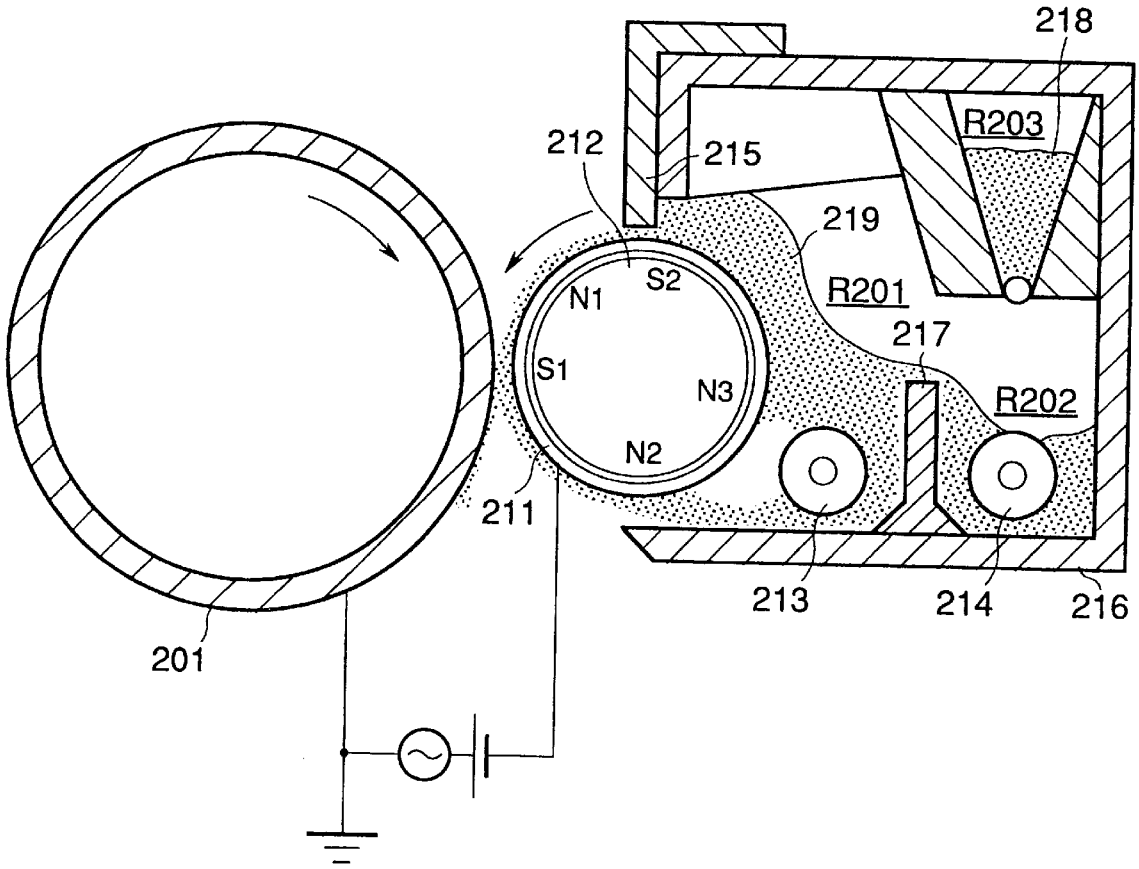
FIG. 6 is a schematic sectional view of a developing device used in the image forming apparatus of FIG. 4.

In the printer portion, an electrostatic latent image is formed in the following manner in response to the image signal. A photosensitive drum 1 is rotated around its drum shaft at a predetermined peripheral speed. During the rotation of the drum, the photosensitive drum 1 is uniformly charged by a charger 3 with positive polarity or negative polarity. Similar to the explanation described in connection with FIG. 5, the uniformly charged surface of the drum is scanned by light emitted from a solid laser element 103 ON/OFF-emission-controlled in response to the image signal by using a polygon mirror 104 rotating at a high speed, thereby forming an electrostatic latent image corresponding to an image of the original on the photosensitive drum 1.

The electrostatic latent image is developed by a developing device 4 to form a toner image on the photosensitive drum 1. The toner image formed on the photosensitive drum 1 is electrostatically transferred onto a transfer material by a transfer charger 7. Thereafter, the transfer material is electrostatically separated from the photosensitive drum by a separation charger 8, and the separated transfer material is sent to a fixing device 6, where the toner image is thermally fixed to the transfer material. Thereafter, the imaged transfer material is discharged from the image forming apparatus.

After the toner image was transferred, residual toner remaining on the photosensitive drum 1 is collected by the developing device 4 during next development.

The above-mentioned arrangement is only an example. Thus, as mentioned above, the charger 3 may be a charge roller in lieu of a corona charger and the transfer charger 7 may be a transfer roller. However, fundamentally, the image formation is performed through charge, exposure, development, transferring, fixing and cleaning processes, and the residual toner is collected into the developing device.

Now, an embodiment of a developing device used in the image forming process of the present invention will be explained with reference to FIG. 2.

Figure 2:
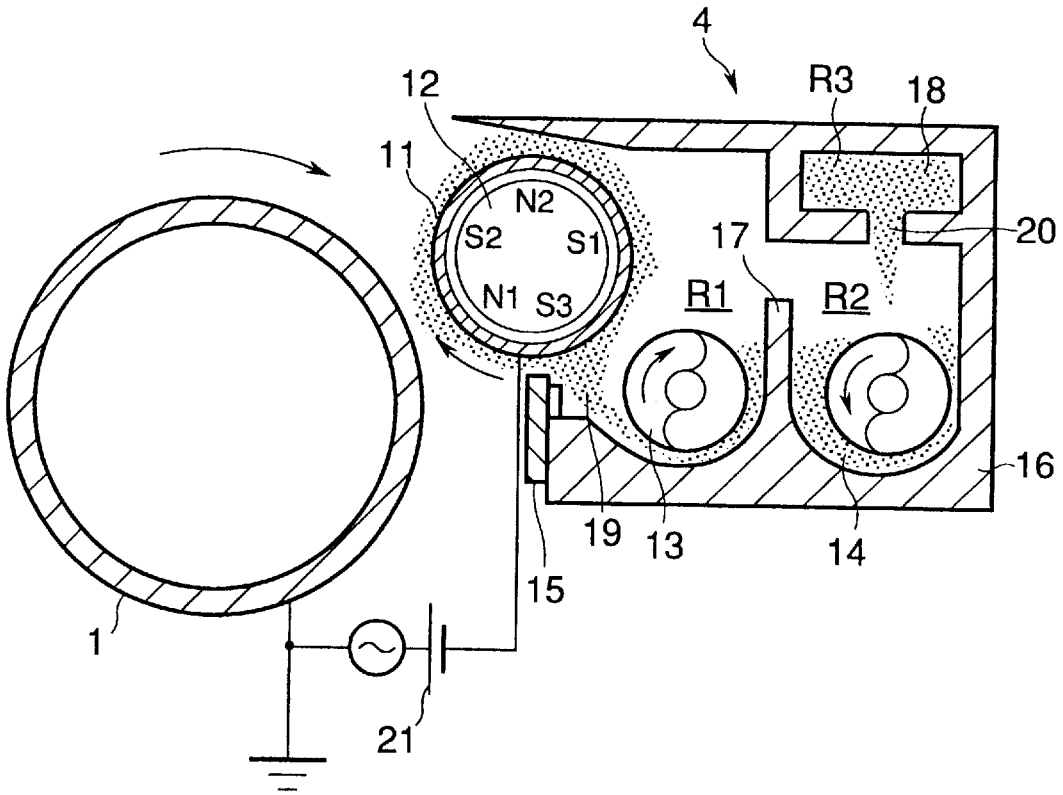
FIG. 2 is a schematic sectional view of a developing device used in the image forming apparatus of FIG. 1.

In FIG. 2, a development container 16 is divided, by a partition 17, into a developing chamber (first chamber) R1 and an agitating chamber (second chamber) R2. A toner reservoir R3 is formed above the agitating (or conveying) chamber R2 and replenishing toner (non-magnetic toner) 18 is contained in the toner reservoir R3. Agitating (or conveying) screws 13, 14 are disposed within the developing chamber R1 and the agitating chamber R2, respectively. The toner reservoir R3 is provided at its bottom with a replenishing opening 20 through which the replenishing toner 18 (amount corresponding to the consumed toner) is replenishing into the agitating chamber R2.

Developer 19 is contained in the developing chamber R1 and the agitating chamber R2. The developer 19 is two-component developer including non-magnetic toner particles (having average particle diameter of 8 $\mu$m) manufactured by a crushing method and by adding titanium oxide particles (having average particle diameter of 20 nm) of 1 weight %, and magnetic particles (carrier particles) having saturated magnetization of 205 emu/cm$^3$ and average particle diameter of 50 $\mu$m. As a mixed ratio, the non-magnetic toner is included by about 5 weight %.

An opening is formed on a part of the development container 16 near the photosensitive drum 1, and a developing sleeve 11 is rotatably mounted within the development container 16 to protrude from the opening. The developing sleeve 11 is formed from non-magnetic material, and a magnet (magnet generating means) 12 is secured within the developing sleeve.

The magnet 12 has a developing magnetic pole N1, a magnetic pole S3 situated at a downstream side of the magnetic pole N1, and magnetic poles N2, S2, S1 for conveying the developer 19. The magnet 12 is disposed within the developing sleeve 11 so that the developing magnetic pole N1 is opposed to the photosensitive drum 1.

The developing magnetic pole N1 generates a magnetic field in the vicinity of a developing portion between the developing sleeve 11 and the photosensitive drum 1, and a magnet brush is formed by the magnetic field. In this position, the developer conveyed (in a direction shown by the arrow) by the-rotation of the developing sleeve 11 is contacted with the photosensitive drum 1, thereby developing the electrostatic latent image on the photosensitive drum 1. In this case, at the position (developing portion) where the developing sleeve 11 approaches the photosensitive drum 1 most, the developing sleeve 11 and the photosensitive drum 1 are moved in opposite directions (counter directions).

Vibration bias voltage obtained by overlapping AC voltage with DC voltage is applied to the developing sleeve 11 from a power source 21. Dark portion potential (non-exposed portion potential) and bright portion potential (exposed portion potential) of the latent image have values between a maximum value and a minimum value of the vibration bias potential. Thus, an alternating electric field (the direction of which is changed alternately) is generated in the developing portion. The toner particles and carrier particles are furiously vibrated. Consequently, the toner overcomes electrostatic holding forces of the developing sleeve 11 and the carrier, with the result that an amount of toner corresponding to the potential of the latent image is adhered to the photosensitive drum 1.

A difference (peak-to-peak voltage) between the maximum value and the minimum value of the vibration bias voltage is preferably 1 to 5 kV, and frequency is preferably 1 to 15 kHz. A waveform of the vibration bias voltage may be rectangular wave form, sine wave form or triangular wave form. The DC voltage component has potential between the dark portion potential and the bright portion potential. However, it is preferable that the absolute value of the potential of the DC voltage component is nearer the absolute value of the bright portion potential (minimum) than the absolute value of the dark portion potential, because fog toner can be prevented from adhering to the dark portion.

A blade 15 is disposed below the developing sleeve 11 to define a gap (for example, 500 $\mu$m, in the illustrated embodiment) therebetween. The blade 15 is formed from non-magnetic material such as aluminum or SUS 316 and is secured to the development container 16. The blade 16 serves to regulate a thickness of a layer of the developer 19 formed on the developing sleeve 11.

The agitating screw 13 disposed within the developing chamber R1 is rotated in a direction shown by the arrow so that the developer 19 in the developing chamber R1 is conveyed toward a longitudinal direction of the developing sleeve 11 by the rotation of the agitating screw 13.

The agitating screw 14 disposed within the agitating chamber R2 serves to convey the toner along the longitudinal direction of the developing sleeve 11, and toner is freely dropped from the-toner reservoir R3 to the agitating chamber R2 through the replenishing opening 20.

The crushed toner used in the illustrated embodiment has a friction charge amount of about $2.0\times10^{-2}$ c/kg.

Now, a method for measuring the friction charge amount of the toner (two-component developer) will be explained with reference to FIG. 3.

Figure 3:
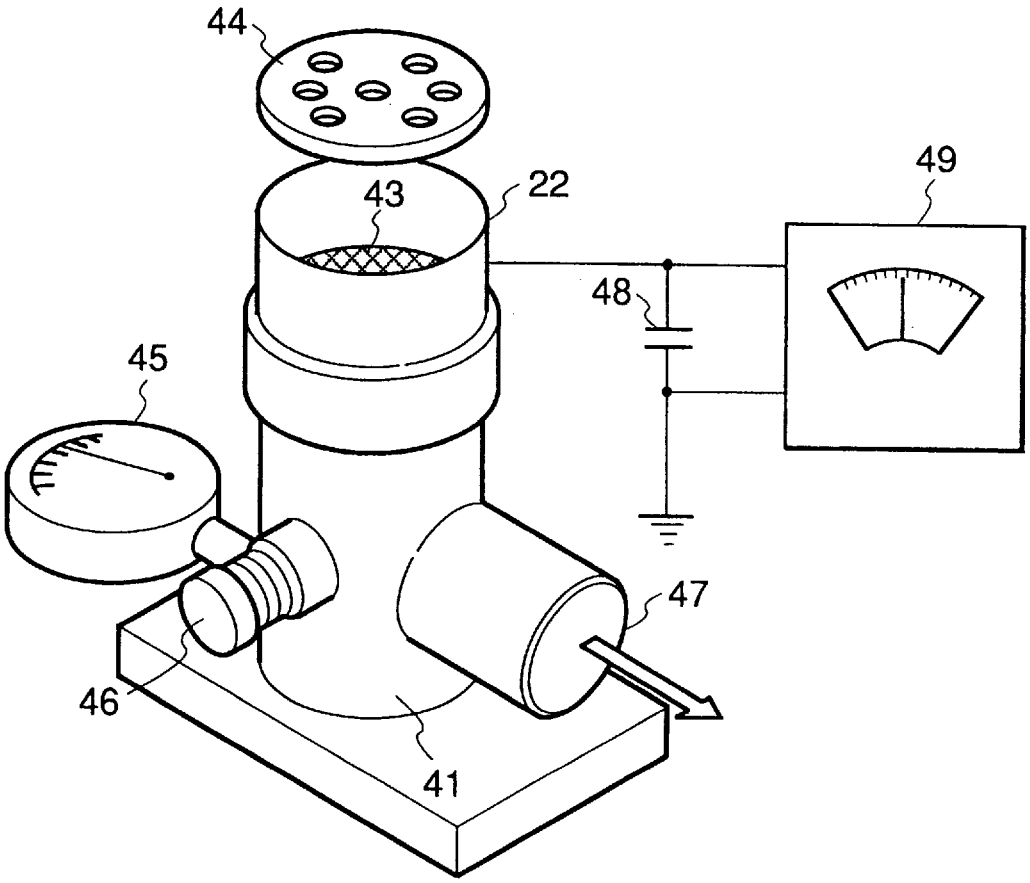
FIG. 3 is a perspective view of a device used for measuring an average charge amount of non-magnetic toner in two-component developer in the present invention.
Figure 4:
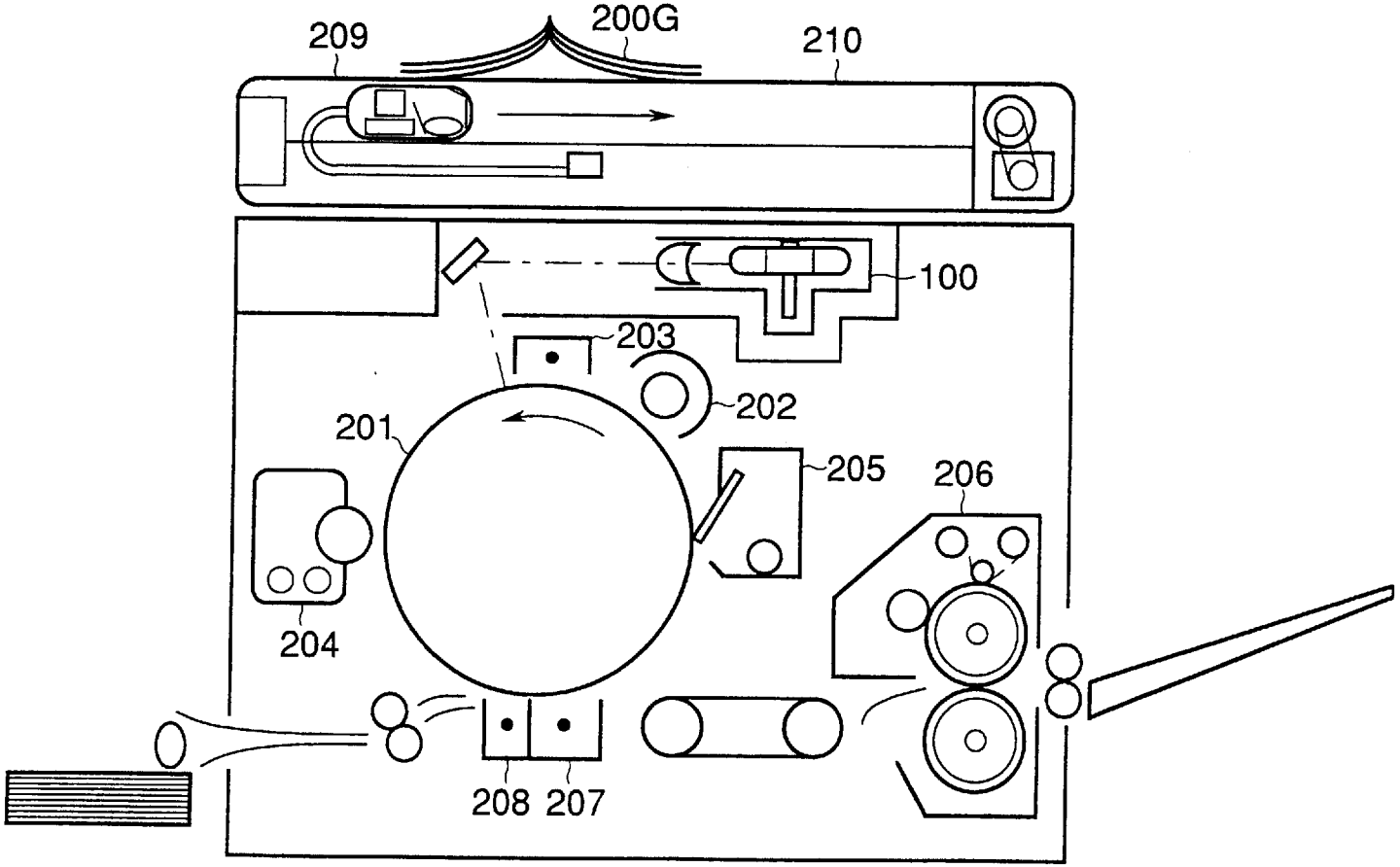
FIG. 4 is a schematic sectional view of a conventional image forming apparatus.

FIG. 3 shows a device for measuring a tribo charge amount of the toner. First of all, two-component developer (friction charge amount of which is to be measured) is contained in a polyethylene bottle having a volume of 50 to 100 ml, and the bottle is manually vibrated for about 10 to 40 seconds. Then, the developer of about 0.5 to 1.5 grams is loaded in a metallic measuring container 42 including a screen 43 having 500 mesh, and a metallic lid 44 is mounted on the container. In this case, it is assumed that the entire weight of the measuring container 42 is W1 (kg).

Then, the measuring container 42 is set in a suction machine 41 (at least a portion which is contacted with the measuring container 42 is formed from insulation material), and suction is effected through a suction opening 47 with pressure of 250 mmAq (adjusted by a blow amount adjusting valve 46 and displayed on a vacuum meter 45). In this condition, the suction is continued for adequate time (preferably, two minutes), thereby removing resin. It is assumed that a potential value of a potentiometer 49 in this case is V (volts). The reference numeral 48 denotes a capacitor having capacity of C (F). It is assumed that the entire weight of the measuring container 42 after suction is W2 (kg). The friction charge amount of the toner is calculated from the following equation:

$$\text{(friction charge amount of resin) } [c/kg]=C\times V\times 10^{-3}/(W1-W2) \quad (1)$$

In an image forming apparatus in which a cleaner is omitted and residual toner after the transferring is removed during the next development, a various tests were performed to judge whether or not the positive ghost is generated, by changing the peripheral speeds of the developing sleeve and the photosensitive drum, regarding the case where the photosensitive drum and the developing sleeve are rotated in the normal directions as is in the conventional technique and the case where the photosensitive drum and the developing sleeve are rotated in the counter directions as is in the illustrated embodiment.

In the tests, a diameter of the developing sleeve was selected to 16 mm and a diameter of the photosensitive drum was selected to 30 mm, and a minimum distance between the developing sleeve and the photosensitive drum was selected to 400 $\mu$m. Further, the friction charge amount of toner was selected to $2.0\times10^{-2}$ c/kg, developer [true density of carrier= 5.1 g/cm$^3$, true density of toner=1.1 g/cm$^3$] of 32 mg per unit area (cm$^2$) was coated on the developing sleeve, fog removing bias $V_{back}$ was set to 150 V (fixed value), and AC bias of 2 kV, 2 kHz was overlapped as the developing bias. Since if the value $V_{back}$ is too small the fog cannot remove from the white background and if the value $V_{back}$ is too great carrier adhesion occurs, in the tests, the value $V_{back}$ was fixed to 150 V as an optimum value.

The following Table 1 shows the test results when the speed ($V_{dr}$) of the photosensitive drum was 50 mm/sec., and Tables 2 and 3 show test results when the speeds of the photosensitive drum were 200 mm/sec. and 300 mm/sec., respectively. In the Tables, as evaluation reference, "Y" indicates a case where the positive ghost could be observed visually, and "N" indicates a case where the positive ghost could not be observed visually. "(Y)" indicates a case where very thin positive ghost was generated.

Incidentally in the Tables, the speed of the developing sleeve is indicated by $V_{s1}$ (mm/sec.) and the speed of the photosensitive drum is indicated by $V_{dr}$ (mm/sec.).

TABLE 1

In case of $V_{dr}$ = 50 mm/sec.

| $V_{s1}$ (mm/sec.) | $\lvert V_{s1}-V_{dr}\rvert$ (mm/sec.) | $\lvert V_{s1}-V_{dr}\rvert/\lvert V_{dr}\rvert$ | positive ghost | image quality uneven stripe |
|---|---|---|---|---|
| +50 | 0 | 0 | Y | A |
| +100 | 50 | 1 | Y | A |
| +150 | 100 | 2 | (Y) | A |
| +200 | 150 | 3 | N | A |
| +250 | 200 | 4 | N | B |
| +300 | 250 | 5 | N | B |
| −50 | 100 | 2 | (Y) | A |
| −100 | 150 | 3 | N | A |
| −150 | 200 | 4 | N | B |
| −200 | 250 | 5 | N | B |
| −250 | 300 | 6 | N | C |
| −300 | 350 | 7 | N | C |

TABLE 2

In case of $V_{dr}$ = 100 mm/sec.

| $V_{s1}$ (mm/sec.) | $\lvert V_{s1}-V_{dr}\rvert$ (mm/sec.) | $\lvert V_{s1}-V_{dr}\rvert/\lvert V_{dr}\rvert$ | positive ghost | image quality uneven stripe |
|---|---|---|---|---|
| +100 | 0 | 0 | Y | A |
| +150 | 50 | 0.5 | Y | A |
| +200 | 100 | 1 | Y | A |
| +250 | 150 | 1.5 | Y | A |
| +300 | 200 | 2 | (Y) | B |
| +350 | 250 | 2.5 | N | B |
| −100 | 200 | 2 | (Y) | B |
| −150 | 250 | 2.5 | N | B |
| −200 | 300 | 3 | N | C |
| −250 | 350 | 3.5 | N | C |
| −300 | 400 | 4 | N | C |
| −350 | 450 | 4.5 | N | C |

TABLE 3

In case of $V_{dr}$ = 200 mm/sec.

| $V_{s1}$ (mm/sec.) | $\lvert V_{s1}-V_{dr}\rvert$ (mm/sec.) | $\lvert V_{s1}-V_{dr}\rvert/\lvert V_{dr}\rvert$ | positive ghost | image quality uneven stripe |
|---|---|---|---|---|
| +200 | 0 | 0 | Y | A |
| +300 | 100 | 0.5 | Y | A |
| +400 | 200 | 1 | Y | B |
| +500 | 300 | 1.5 | Y | C |
| +600 | 400 | 2 | (Y) | C |
| −200 | 400 | 2 | (Y) | C |
| −300 | 500 | 2.5 | N | C |
| −400 | 600 | 3 | N | C |
| −500 | 700 | 3.5 | N | C |
| −600 | 800 | 4 | N | C |

According to the Tables 1, 2 and 3, if the above conditions are fixed, in the case where the developing sleeve was rotated in the normal direction, when the peripheral speed ratio ($V_{s1}/V_{dr}$; not shown in the Tables) between the photosensitive drum and the developing sleeve is 3.5 or more, and, in the case where the developing sleeve was rotated in the counter direction, when the peripheral speed ratio between the photosensitive drum and the developing sleeve is 1.5 or more, the positive ghost could not observed visually.

As a result of various tests, it was found that, in a condition where the surface feature of the photosensitive drum, various physical features of the toner (including the friction charge amount of toner), $V_{back}$ and developing bias are constant, the collecting ability of the residual toner during the development is proportional to an area of the magnet brush contacted with the surface (per unit area) of the photosensitive drum, as shown by the following equation (2):

$$(|V_{S1}-V_{dr}|/|V_{dr}|)\times L\times m\times\alpha\geqq 7 \quad (2)$$

where, $V_{s1}$ is a speed (mm/sec.) of the developing sleeve, $V_{dr}$ is a speed (mm/sec.) of the photosensitive drum, L is contact NIP (mm), m is a cross-sectional area ($mm^2$) of the magnet brush and $\alpha$ is density (flux/$mm^2$) of the magnet brush. Incidentally, $|V_{S1}-V_{dr}|$is an absolute value of vector sum of the respective peripheral speeds.

Now, the area of the magnet brush contacted with the surface (per unit area) of the photosensitive drum will be briefly explained. It is assumed that, the speed of the developing sleeve (speed of the magnet brush) is $V_{s1}$ (mm/sec.), the speed of the photosensitive drum is $V_{dr}$ (mm/sec.), the relative speed $|V_{s1}-V_{dr}|$ between the developing sleeve and the photosensitive drum at the minimum distance portion is always constant at a zone (referred to as "contact NIP" hereinafter) where the magnet brush is contacted with the photosensitive drum, and, meanwhile, the magnet brush is contacted with the photosensitive drum with the same (constant) magnitude (diameter). In this case, when a length of the contact NIP (along a circumferential direction of the photosensitive drum) is L (mm), a time period t (sec.) during when the residual toner adhered to the unit area (in the longitudinal direction) of the photosensitive drum passes through the contact NIP becomes $L/V_{dr}$ (sec.), and, when the density of the magnet brush of the developing magnetic pole is a (flux/$mm^2$) and the magnitude (cross-sectional area) of the magnet brush is m ($mm^2$), the area of the magnet brush contacted with the unit area of the photosensitive drum for a unit time becomes $m\times\alpha\times|V_{s1}-V_{dr}|$ (flux-mm-sec.). Accordingly, the area of the magnet brush contacted with the residual toner adhered to the unit area of the photosensitive drum is represented by:

$$L/V_{dr}\times m\times\alpha\times|V_{s1}-V_{dr}|.$$

The above Tables 1, 2 and 3 show the results obtained when the length L of the contact NIP was 7 mm, the cross-sectional area m of the magnet brush was 0.125 $mm^2$ and the density a of the magnet brush was 4 (flux/$mm^2$).

From the results shown in the Tables 1, 2 and 3, in order to collect the residual toner by 100% at the developing portion, in the method in which the developing sleeve is rotated in the normal direction (normal direction development), the developing sleeve must be rotated faster than the photosensitive drum by about 3.5 times. In this case, the developer is easily degraded and the toner is apt to be scattered.

To the contrary, by using the method in which the developing sleeve is rotated in the counter direction (counter development), it is possible to increase the peripheral speed difference between the developing sleeve (magnet brush) and the photosensitive drum without rotating the developing sleeve at a high speed. This is more advantageous regarding the prevention of toner scattering and degradation of developer in comparison with normal direction development, in the cleaner-less apparatus wherein the residual toner is collected during the development.

In dependence upon image ratio of the copy image, generally, in the counter development, when the residual toner reaches the developing portion, since the developer (on the developing sleeve) (T/C ratio of which was reduced after development) encounters with the residual toner, the residual toner can easily be collected.

As mentioned above, in the opposed area between the photosensitive drum and the developing sleeve, when it is assumed that the moving speed of the developing sleeve is $V_{s1}$ (mm/sec.), the moving speed of the photosensitive drum is $V_{dr}$ (mm/sec.), the length (contact NIP) (along the moving direction of the photosensitive drum) of the area (developing portion) of the developing sleeve contacted with the two-component developer is L (mm), the cross-sectional area of the magnet brush is m ($mm^2$) and the density of the magnet brush is a (flux/$mm^2$), by satisfying the following relation (2), it is possible to collect the residual toner by 100% and to obtain the good image:

$$(|V_{s1}-V_{dr}|/|V_{dr}|)\times L\times m\times\alpha\geqq 7 \quad (2)$$

(Incidentally, $|V_{s1}-V_{dr}|$ is an absolute value of vector sum of the respective peripheral speeds)

Further, in the opposed area between the photosensitive drum and the developing sleeve, by moving the two-component developer and the photosensitive drum in the opposite directions (counter directions), it is possible to satisfy the above relation (2) with smaller peripheral speed ratio (ratio of the developing sleeve relative to the speed of the photosensitive drum) in comparison with the normal rotation development. This also provides a high stable developing device having long service life and reduced toner scattering.

[Second Embodiment]

In the first embodiment, while an example that toner manufactured by crushing method is used as the toner particles was explained, in a second embodiment of the present invention, toner obtained by adding titanium oxide (having average particle diameter of 20 nm) of 1 weight % to spherical toner particles (having average particle diameter of 6 $\mu$m) manufactured by suspension polymerization is used. Further, magnetic carrier particles having saturated magnetization of 205 emu/$cm^3$ and average particle diameter of 35 $\mu$m are used.

Developer is obtained by mixing the toner with the carrier at a weight ratio of 7:93. Since the toner particles manufactured by the polymerization have substantially spherical shapes, the titanium oxide is uniformly coated on the toner particles. Thus, the excellent mold releasing ability to the photosensitive drum can be obtained. For example, in comparison with the crushed toner and the polymerized toner regarding transfer efficiency [(transferred toner amount per unit area)/(toner amount remaining on the photosensitive drum per unit area)], it was found that the transfer efficiency of the crushed toner is 90%, whereas, the transfer efficiency of the polymerized toner is 97% (higher than the former).

In the cleaner-less apparatus wherein the residual toner is collected during the development, when the polymerized toner is used, since not only the amount of the residual toner small but also the good mold releasing ability is obtained, the collecting ability can be improved and the positive ghost is hard to be generated.

When the polymerized toner was used and the speed of the photosensitive drum was selected to 100 mm/sec., and the other conditions were the same as those in the above Table 2, the rest results regarding the evaluation of the positive ghost is shown in the following Table 4.

TABLE 4

| In case of $V_{dr}$ = 100 mm/sec. | | | |
|---|---|---|---|
| $V_{s1}$ (mm/sec.) | $\|V_{s1} - V_{dr}\|$ (mm/sec.) | $\|V_{s1} - V_{dr}\|/\|V_{dr}\|$ | positive ghost |
| +100 | 0 | 0 | Y |
| +150 | 50 | 0.5 | Y |
| +200 | 100 | 1 | Y |
| +250 | 150 | 1.5 | (Y) |
| +300 | 200 | 2 | N |
| +350 | 250 | 2.5 | N |
| −100 | 200 | 2 | N |
| −150 | 250 | 2.5 | N |
| −200 | 300 | 3 | N |
| −250 | 350 | 3.5 | N |
| −300 | 400 | 4 | N |
| −350 | 450 | 4.5 | N |

The test results shown in the Table 4 indicates the fact that, in order to collect the residual toner by 100% at the developing portion, in the method in which the developing sleeve is rotated in the normal direction, the developing sleeve must be rotated faster than the photosensitive drum by about 3.0 times, and, in the method in which the developing sleeve is rotated in the counter direction, the developing sleeve must be rotated faster than the photosensitive drum by about 1.0 time. Comparing this fact with the crushed toner in the first embodiment, when the polymerized toner is used, the residual toner can be collected by 100% with smaller peripheral speed ratio.

Next, the magnetic carrier and the non-magnetic toner will be fully explained.

The magnetic carriers used in the illustrated embodiment are small diameter carrier particles having number average particle diameter smaller than 100 μm. Generally, the particle diameter of the magnetic carrier should be reduced as less as possible from the view point of high image quality. Thus, in the illustrated embodiment, the number average particle diameter of the magnetic carrier is selected to 100 μm, and preferably, 10 to 60 μm.

In the above, the number average particle diameter of the magnetic carrier is indicated by a maximum cord length of the magnetic carrier particle in a vertical direction. In the present invention, carrier powder is expanded to disperse carrier particles which are in turn photo-taken by the microscope camera with magnification of 500 to 1000, and 300 or more carrier particle images are selected from the picture and longer axes (maximum cord lengths in the vertical direction) of the selected carrier particle images are measured. Then, the number average particle diameter is determined by averaging the measured values.

In the present invention, resin carrier of magnetic substance dispersing type highly coated by resin by dispersing magnetic power in bonding resin is used as the magnetic carrier. The magnetic substance may be, for example, ferromagnetic metal such as iron, cobalt or nickel, or, alloy or compound ferrite, magnetite or hematite including ferromagnetic metal such as iron, cobalt or nickel.

The magnetization of the magnetic carrier used in the present invention is selected to 30 to 200 emu/cm$^3$ in the magnetic field having 1000 Gauss. The magnetic property of the magnetic carrier is measured an oscillation magnetic field type magnetic property automatic recording apparatus BHV-30 manufactured by Riken Densi Co., Ltd. (in Japan).

Specific resistance of the magnetic carrier should be greater than $10^{12}$ Ωcm in electric field intensity of $5\times10^4$ V/m. If the specific resistance is smaller than this value, carrier adhesion and deterioration of image quality will occur, with the result that the object of the present invention (high quality fine image) cannot be achieved. Particularly, as is in the present invention, when the carrier having small magnetization is used and the carrier is held on the developing sleeve magnetically weakly, if the specific resistance of the carrier is small, charge is apt to be applied to the carrier upon application of the developing bias, thereby generating carrier adhesion.

The measurement of the specific resistance of the carrier is effected by loading the carrier powder in a cell and arranging two electrodes on top and bottom of the loaded carrier and then by applying voltage between the electrodes while acting a weight on the upper electrode and measuring current generated in this way. As measuring conditions, a contact area between the carrier and the electrodes was selected to about 2.3 cm$^2$, a thickness of loaded carrier layer was selected to about 2 mm, the weight applied to the upper electrode was selected to 180 grams and the applied voltage was selected to 1000 V. In this case, since the carrier is in a powder form, there arises a difference in loading amount of carrier in the cell, with the result that the measured value of the specific resistance may be changed. Thus, attention is required.

Conventional toner obtained by adding coloring agent and/or charge controlling agent to binder resin may be used as the non-magnetic toner. The volume average particle diameter of the non-magnetic toner is preferably 5 to 15 μm. In the present invention, since the cleaning of the photosensitive drum is effected simultaneously with the development, it is preferable that toner such as polymerized toner having high transfer efficiency is used.

Since the polymerized toner manufactured by polymerization includes substantially spherical toner particles, an additive can uniformly coated on the toner particles. Thus, the mold releasing ability of the toner regarding the photosensitive drum and the transferring ability regarding the transfer material are very excellent. For example, when the toner on the photosensitive drum is transferred onto the transfer material (paper sheet), in comparison with the polymerized toner and the crushed toner regarding the transfer efficiency [i.e., (toner amount on unit area of the paper sheet)/(toner amount on unit area of the photosensitive drum)], the transfer efficiency of the crushed is about 90%, whereas, the transfer efficiency of the polymerized toner is 97% (higher than the former).

When the polymerized toner is used, since not only the amount of the residual toner small but also the good mold releasing ability is obtained, the residual toner can easily be removed and collected by the cleaning during the development without any cleaner and the positive ghost is prevented from being generated.

In the illustrated embodiment, toner obtained by adding titanium oxide (having average particle diameter of 20 nm) of 1 weight % to polymerized toner (having average particle diameter of 6 μm) manufactured by suspension polymerization is used as the non-magnetic toner. Further, magnetic carrier particles having saturated magnetization of 205 emu/cm$^3$ and average particle diameter of 50 μm are used as the magnetic carrier. The mixing ratio between the toner and carrier in the two-component developer is selected to 7:93 (weight %).

The volume average particle diameter of toner can be measured by the following measuring method, for example. Coal counter TA-II Type (manufactured by Coal Tar Inc.) is used as a measuring device to which interface (manufactured by Nikkaki Co., Ltd.) and CX-i personal computer (manufactured by Canon Inc.) for outputting number average distribution and volume average distribution are connected.

As electrolytic solution, 1% Nacl aqueous solution is prepared by using first class sodium chloride. Surface-active agent (preferably, alkyl benzene sulfonate) of 0.1 to 5 mg is added to the electrolytic solution of 100 to 150 mg as dispersing agent, and toner (specimen to be measured) of 0.5 to 50 mg is further added.

The electrolytic solution suspending the specimen is dispersion-treated by ultrasonic dispersing device for 1 to 3 minutes, and then, particle size distribution of the particles of 2 to 40 $\mu$m is measured by means of the above-mentioned Coal counter TA-II Type through aperture of 100 $\mu$m, thereby seeking volume distribution of the toner. The volume average particle diameter of the toner can be determined on the basis of the volume distribution.

Now, a method for measuring a width h of the contact NIP will be explained.

A both-face adhesive tape is adhered to the surface of the photosensitive drum, and the developing sleeve is opposed to the photosensitive drum with a gap (corresponding to the developing gap) of 400 $\mu$m between the both-face adhesive tape and the developing sleeve. The photosensitive drum is kept stationary, and the developing sleeve alone is rotated without applying the developing bias. On the basis of a length (in the circumferential direction of the photosensitive drum) of the developer adhered to the both-face adhesive tape on the photosensitive drum, a circumferential length of the area with which the developer is contacted is measured, thereby obtaining the length h of the contact NIP.

The cross-sectional area and density of the magnet brush are measured by the magnet brush having cocked spikes on the developing sleeve is compressed between the developing sleeve and the photosensitive drum (gap of 400 $\mu$m) and by observing an area (of 3×10 $mm^2$) of the compressed magnet brush by means of an optical microscope. The measurements are repeated by plural times, and average values (of cross-sectional area and of the density) are used.

As can be understood from the above explanations, although the positive ghost can be reduced to a negligible level by increasing the relative speed between the photosensitive drum and the magnet brush, regarding the image quality, if the relative speed between the photosensitive drum and the magnet brush is too great, the toner image will be scraped by the magnet brush to reduce smoothness of the image (particularly, at low density portions), thereby deteriorating the image quality, and, in hi-light-half tone density areas, scraped stripe unevenness will occur.

In the above Tables 1 to 3, symbols (A, B, C) shown in the column of "image quality" indicate as follows:

A: no uneven stripe,

B: uneven stripes are not noticeable, and

C: Uneven stripes are noticeable.

If the relative speed between the photosensitive drum and the magnet brush is greater than 300 mm/sec., the uneven stripes become noticeable. As can be seen from the Tables 1 to 3, this is disadvantageous in the cleaner-less apparatus wherein the residual toner is collected during the development according to the present invention, particularly when the peripheral speed of the photosensitive drum is increased.

As a result of investigation, it was found that the scraping of the toner image by the magnet brush greatly depends upon contact pressure by which the photosensitive drum is pressed by the magnet brush formed by the developer on the developing sleeve in the magnetic field at the developing portion and the relative speed between the photosensitive drum and the developing sleeve, and, particularly when the magnet brush is situated at a downstream side of the developing portion, the scraping of the toner image is apt to occur. Accordingly, in the counter development in which the relative speed is great, the scraping of the toner image is particularly apt to occur.

The contact pressure of the magnet brush greatly depends upon the condition of the cocked spikes of the magnet brush (i.e., intensity of magnetization ad per unit area of the magnetic carrier when intensity (d) of peak magnetic field is applied to the developing electrode) when the packing density of the developer in the developing area is identical (i.e., when the developer coated on the developing sleeve with the same volume is positioned within the same developing gap (S-D gap)), and, accordingly, it was found that, when the value ad is decreased, the contact pressure becomes smaller. (Incidentally, "d" in "σd" is an affixed symbol indicting the intensity of the peak magnetic field).

It is considered that the reason is that, although each spike in the developing magnetic field acts as a bar magnet when the spikes are formed by the carrier particles in the developing magnetic field, if the intensity of the magnetization of the carrier is reduced, since a force acting between the carrier particles becomes smaller, the spikes are apt to be fallen, with the result that the pressure of the brush is reduced.

Accordingly, in the illustrated embodiment, regarding the collecting ability for the residual toner, in consideration of the fact that the area of the magnet brush contacted with the unit area of the photosensitive drum should be increased, the pressure pressing the photosensitive drum is reduced by reducing the intensity of the magnetization of the magnetic carrier while increasing the relative speed between the photosensitive drum and the magnet brush. More specifically, by selecting the intensity of the magnetization of the carrier to 30 to 200 emu/$cm^3$ (σ1000=30 to 200 emu/$cm^3$) in the magnetic field of 1000 Gauss, the residual toner can be collected by 100% and at the same time the image quality can be improved. If the intensity of the magnetization of the carrier is smaller than 30 emu/$cm^3$, conveying ability of the developer on the developing sleeve is worsened, thereby deteriorating the image quality and/or causing the scattering of developer. Thus, the intensity of the magnetization of the carrier cannot be reduced below 30 emu/$cm^3$. The test results are shown in the following Tables 5 to 7.

TABLE 5

In case of $V_{dr}$ = 50 mm/sec., σ1000 = 30 to 200 emu/$cm^3$

| $V_{s1}$ (mm/sec.) | $\lvert V_{s1} - V_{dr}\rvert$ (mm/sec.) | $\lvert V_{s1} - V_{dr}\rvert / \lvert V_{dr}\rvert$ | positive ghost | image quality uneven stripe |
|---|---|---|---|---|
| +50 | 0 | 0 | Y | A |
| +100 | 50 | 1 | Y | A |
| +150 | 100 | 2 | (Y) | A |
| +200 | 150 | 3 | N | A |
| +250 | 200 | 4 | N | A |
| +300 | 250 | 5 | N | A |
| −50 | 100 | 2 | (Y) | A |
| −100 | 150 | 3 | N | A |
| −150 | 200 | 4 | N | A |
| −200 | 250 | 5 | N | A |
| −250 | 300 | 6 | N | A |
| −300 | 350 | 7 | N | A |

TABLE 6

| In case of $V_{dr}$ = 100 mm/sec., σ1000 = 30 to 200 emu/cm$^3$ | | | | |
|---|---|---|---|---|
| $V_{s1}$ (mm/sec.) | $\lvert V_{s1} - V_{dr}\rvert$ (mm/sec.) | $\lvert V_{s1} - V_{dr}\rvert / \lvert V_{dr}\rvert$ | positive ghost | image quality uneven stripe |
| +100 | 0 | 0 | Y | A |
| +150 | 50 | 0.5 | Y | A |
| +200 | 100 | 1 | Y | A |
| +250 | 150 | 1.5 | Y | A |
| +300 | 200 | 2 | (Y) | A |
| +350 | 250 | 2.5 | N | A |
| −100 | 200 | 2 | (Y) | A |
| −150 | 250 | 2.5 | N | A |
| −200 | 300 | 3 | N | A |
| −250 | 350 | 3.5 | N | A |
| −300 | 400 | 4 | N | A |
| −350 | 450 | 4.5 | N | A |

TABLE 7

| In case of $V_{dr}$ = 200 mm/sec., σ1000 = 30 to 200 emu/cm$^3$ | | | | |
|---|---|---|---|---|
| $V_{s1}$ (mm/sec.) | $\lvert V_{s1} - V_{dr}\rvert$ (mm/sec.) | $\lvert V_{s1} - V_{dr}\rvert / \lvert V_{dr}\rvert$ | positive ghost | image quality uneven stripe |
| +200 | 0 | 0 | Y | A |
| +300 | 100 | 0.5 | Y | A |
| +400 | 200 | 1 | Y | A |
| +500 | 300 | 1.5 | Y | A |
| +600 | 400 | 2 | (Y) | A |
| −200 | 400 | 2 | (Y) | A |
| −300 | 500 | 2.5 | N | A |
| −400 | 600 | 3 | N | A |
| −500 | 700 | 3.5 | N | A |
| −600 | 800 | 4 | N | A |

In the above Tables 5 to 7, the carrier having magnetization of 150 emu/cm$^3$ in the magnetic field of 1000 Gauss was used, and, as is in the above-mentioned Tables 1 to 3, the image formation was effected by changing the peripheral speeds of the developing sleeve and the photosensitive drum to check the occurrence of the positive ghost and the image quality (hi-light uneven stripe). In the tests, since the magnetization of the carrier was reduced in comparison with the Tables 1 to 3, lengths of the spikes of the magnet brush became shorter and a cross-sectional area of each spike of the magnet brush became smaller, and the density of the magnet brush was increased, and the length of the contact NIP became 7 (mm), the cross-sectional area of the magnet brush became 0.05 (mm$^2$) and the density of the magnet brush became 10 (flux/mm$^2$).

In the Tables 5 to 7, as is in the Tables 1 to 3, in the normal direction development, when the peripheral speed ratio $V_{s1}/V_{dr}$ (not shown in the Tables) between the developing sleeve and the photosensitive drum was greater than 3.5 or more, the positive ghost could not observed visually. In the counter development, when the peripheral speed ratio between the developing sleeve and the photosensitive drum was greater than 1.5 or more, the positive ghost could not observed visually. The uneven stripes were not generated even when the relative speed between the developing sleeve (magnet brush) and the photosensitive drum was 800 mm/sec..

As mentioned above, in the present invention, by using the magnet brush formed by the two-component developer born on the developing sleeve of the developing device, the latent image formed on the photosensitive drum is developed and the residual toner remaining on the photosensitive drum is removed and collected, thereby obtaining the good image.

In this case, (i) the carrier having the specific resistance greater than $10^{12}$ Ωcm in the electric field intensity of $5\times10^4$ V/m and the magnetization of 30 to 200 emu/cm$^3$ in the magnetic field of 1000 Gauss is used; and (ii) the peripheral speeds of the developing sleeve and of the photosensitive drum, the length of the contact NIP of the magnet brush and the like satisfy the following relation:

$$|V_{s1}-V_{dr}|/V_{dr}\times h\times m\times\alpha\geqq 7 \quad (3)$$

where, $V_{s1}$ is a peripheral speed (mm/sec.) of the developing sleeve, $V_{dr}$ is a peripheral speed (mm/sec.) of the photosensitive drum, h (mm) is a length of the contact NIP between the magnet brush and the photosensitive drum, m is a cross-sectional area (mm$^2$) of the magnet brush and α is density (flux/mm$^2$) of the magnet brush. Incidentally, $|V_{s1}-V_{dr}|$ is an absolute value (mm/sec.) of the relative peripheral speed of the developing sleeve with respect to the photosensitive drum at the nearest position between the developing sleeve and the photosensitive drum.

In the present invention, by adopting the above arrangements (i) and (ii), the residual toner can be collected by 100% and a high quality image having no uneven stripe can be obtained.

Further, by adopting the counter development in which the moving direction of the developing sleeve is opposite to the moving direction of the photosensitive drum at the developing portion, the above relation (2) can be satisfied by smaller peripheral speed ratio of the developing sleeve relative to the photosensitive drum in comparison with the normal direction development. This can provide a high stable developing device having a longer service life and less developer scattering.

[Third Embodiment]

In a third embodiment of the present invention, the gap between the developing sleeve 11 and the photosensitive drum 1 is selected to 300 μm and the length h of the contact NIP is selected to 9.5 mm. The speed of the photosensitive drum is selected to 100 mm/sec., and conditions other than the length h of the contact NIP are the same as those shown in the Table of the second embodiment.

The test results regarding the evaluation of the positive ghost is shown in the following Table 8.

TABLE 8

| In case of $V_{dr}$ = 100 mm/sec., σ1000 = 30 to 200 emu/cm$^3$ | | | | |
|---|---|---|---|---|
| $V_{s1}$ (mm/sec.) | $\lvert V_{s1} - V_{dr}\rvert$ (mm/sec.) | $\lvert V_{s1} - V_{dr}\rvert / \lvert V_{dr}\rvert$ | positive ghost | image quality uneven stripe |
| +100 | 0 | 0 | Y | A |
| +150 | 50 | 0.5 | Y | A |
| +200 | 100 | 1 | Y | A |
| +250 | 150 | 1.5 | (Y) | A |
| +300 | 200 | 2 | N | A |
| +350 | 250 | 2.5 | N | A |
| −100 | 200 | 2 | N | A |
| −150 | 250 | 2.5 | N | A |
| −200 | 300 | 3 | N | A |
| −250 | 350 | 3.5 | N | A |
| −300 | 400 | 4 | N | A |
| −350 | 450 | 4.5 | N | A |

As can be seen from the Table 8, in order to collect the residual toner remaining on the photosensitive drum by 100% simultaneously with the formation of the latent image, in the normal direction development, the developing sleeve must be rotated faster than the photosensitive drum by at least about 3.0 times, whereas, in the counter development, the developing sleeve may be rotated faster than the photosensitive drum by about 1.0 time.

Comparing with the first embodiment, by increasing the length of the contact NIP, the residual toner can be collected by 100% with smaller peripheral speed ratio. Also in this case, it was found that the uneven stripes are not generated by using toner having magnetization of 150 emu/cm$^3$ in the magnetic field of 1000 Gauss.

While the present invention was explained with reference to specific embodiments, the present invention is not limited to such embodiments, but, various alterations can be made within the scope of the invention.

What is claimed is:

1. An image forming apparatus comprising:

an image bearing member for bearing an electrostatic image to be developed by toner;

a transfer means for transferring a toner image formed on said image bearing member onto a transfer material; and a developing and cleaning means for developing the electrostatic image with a developer including toner and carrier, and for cleaning residual toner remaining on said image bearing member after transferring, said developing and cleaning means having a developer bearing member for bearing the developer and serving to effect development and cleaning by causing a magnet brush formed by the carrier to contact with said image bearing member;

wherein the following relation is satisfied;

$$|V_{s1}-V_{dr}|/|V_{dr}|\times L\times m\times\alpha\geqq 7$$

where, $V_{s1}$ is a moving speed (mm/sec.) of a surface of said developer bearing member, $V_{dr}$ is a moving speed (mm/sec.) of a surface of said image bearing member, L is a contact width (mm) of said magnet brush in a moving direction of said image bearing member, m is a cross-sectional area (mm$^2$) of said magnet brush, and $\alpha$ is density (flux/mm$^2$) of said magnet brush.

2. An image forming apparatus according to claim 1, wherein the toner is manufactured by polymerization.

3. An image forming apparatus according to claim 1, wherein said image bearing member and said developer bearing member are moved in opposite directions at a portion where said image bearing member and said developer bearing member are opposed.

4. An image forming apparatus according to claim 1, wherein the carrier has specific resistance greater than $10^{12}$ Ωcm in intensity of an electric field of $5\times10^4$ V/m, and magnetization of 30 to 200 emu/cm$^3$ in a magnetic field of 1000 Gauss.

5. An image forming apparatus according to claim 4, wherein said image bearing member and said developer bearing member are moved in opposite directions at a portion where said image bearing member and said developer bearing member are opposed, and the value $V_{s1}$ is greater than the value $V_{dr}$ by 1.5 times or more.

6. An image forming apparatus according to claim 4, wherein said image bearing member and said developer bearing member are moved in the same directions at a portion where said image bearing member and said developer bearing member are opposed, and the value $V_{s1}$ is greater than the value $V_{dr}$ by 3.5 times or more.

* * * * *

UNITED STATES PATENT AND TRADEMARK OFFICE

CERTIFICATE OF CORRECTION

PATENT NO. : 5,870,656

DATED : February 9, 1999

INVENTOR(S) : MASARU HIBINO, ET AL.

It is certified that error appears in the above-identified patent and that said Letters Patent is hereby corrected as shown below:

COLUMN 1,
Line 15, "the" should read --of the--.

COLUMN 2,
Line 27, "foul" should read --four--.

COLUMN 3,
Line 28, "and" should read --and has--.

COLUMN 6,
Line 15, "the-rotation" should read --the rotation--;
Line 40, "wave form," should read --waveform,--, ~~and "wave form" should read --waveform--~~;
Line 41, "wave form." should read --waveform.--; and
Line 64, "the-toner" should read --the toner--.

COLUMN 7,
Line 32, "a" should be deleted.

COLUMN 9,
Line 10, "$|V_{s1} - V_{dr}|$is" should read --$|V_{s1} - V_{dr}|$ is--; and
Line 43, "a" should read --$\alpha$--.

UNITED STATES PATENT AND TRADEMARK OFFICE

CERTIFICATE OF CORRECTION

PATENT NO. : 5,870,656

DATED : February 9, 1999

INVENTOR(S) : MASARU HIBINO, ET AL.

It is certified that error appears in the above-identified patent and that said Letters Patent is hereby corrected as shown below:

COLUMN 10,
Line 19, "speeds)" should read --speeds.)--.

COLUMN 13,
Line 50, "Uneven" should read --uneven--.

COLUMN 14,
Line 6, "ad" should read --σd--.

COLUMN 15,
Line 53, "not" should read --not be--; and
Line 56, "not" should read --not be--.

COLUMN 17,
Line 31, "satisfied;" should read --satisfied:--.

Signed and Sealed this

Eleventh Day of January, 2000

*Attest:*

*Attesting Officer*

Q. TODD DICKINSON

*Acting Commissioner of Patents and Trademarks*